US010839647B2

(12) United States Patent
Potts et al.

(10) Patent No.: US 10,839,647 B2
(45) **Date of Patent: *Nov. 17, 2020**

(54) MULTI-FUNCTION CASHLESS GAMING ATM

(71) Applicant: Everi Payments Inc., Austin, TX (US)

(72) Inventors: Craig Potts, Henderson, NV (US); Richard Beer, Prior Lake, MN (US)

(73) Assignee: Everi Payments Inc., Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/379,543

(22) Filed: Apr. 9, 2019

(65) Prior Publication Data

US 2019/0236899 A1 Aug. 1, 2019

Related U.S. Application Data

(63) Continuation of application No. 15/137,693, filed on Apr. 25, 2016, now Pat. No. 10,275,983, which is a (Continued)

(51) Int. Cl.

| | |
|---|---|
| ***G07F 17/32*** | (2006.01) |
| ***A63F 3/00*** | (2006.01) |
| ***G07F 19/00*** | (2006.01) |

(52) U.S. Cl.

CPC ..... *G07F 17/3248* (2013.01); *A63F 3/00157* (2013.01); *G07F 17/32* (2013.01); (Continued)

(58) Field of Classification Search

None

See application file for complete search history.

(56) References Cited

U.S. PATENT DOCUMENTS

| | | | |
|---|---|---|---|
| 4,689,742 | A | 8/1987 | Troy et al. |
| 4,764,666 | A | 8/1988 | Bergeron |

(Continued)

FOREIGN PATENT DOCUMENTS

| | | |
|---|---|---|
| EP | 1 107 196 | 6/2001 |
| GB | 2 380 687 | 4/2003 |

(Continued)

OTHER PUBLICATIONS

Quinn, William, "Worth Their Weight in Gold," pp. 24-26, Global Gaming Business, Apr. 1, 2003.

(Continued)

*Primary Examiner* — Seng H Lim

(74) *Attorney, Agent, or Firm* — Weide & Miller, Ltd.

(57) ABSTRACT

A system and method are provided for performing a cashless gaming ticket redemption transaction for a customer in a casino environment. The system includes a gaming machine, such as a slot machine, that the customer plays. Rather than issuing cash to the customer, the gaming machine issues a redemption ticket with a unique identifier to the customer. The unique identifier and the amount of the customer's winnings accrued on the gaming machine are stored and associated on a redemption ticket database. When the customer wishes to redeem the winnings, the redemption ticket is introduced to a multi-function ATM. To perform the ticket redemption transaction, the ATM is adapted to electronically accept the redemption ticket and read the unique identifier. The ATM then electronically communicates with the redemption database to retrieve the predetermined dollar value associated with the unique identifier. Finally, the ATM transfers to the customer an award equal to the predetermined dollar value in cash or credit.

32 Claims, 7 Drawing Sheets

Related U.S. Application Data continuation of application No. 14/051,156, filed on Oct. 10, 2013, now Pat. No. 9,324,210, which is a continuation of application No. 10/956,644, filed on Oct. 1, 2004, now Pat. No. 8,556,707.

(60) Provisional application No. 60/508,063, filed on Oct. 1, 2003.

(52) U.S. Cl.
CPC ..... *G07F 17/3225* (2013.01); *G07F 17/3244* (2013.01); *G07F 17/3246* (2013.01); *G07F 17/3255* (2013.01); *G07F 19/00* (2013.01); *G07F 19/20* (2013.01); *G07F 19/203* (2013.01)

(56) References Cited

U.S. PATENT DOCUMENTS

| | | | |
|---|---|---|---|
| 4,882,473 | A | 11/1989 | Bergeron et al. |
| 5,038,022 | A | 8/1991 | Lucero |
| 5,179,517 | A | 1/1993 | Sarbin et al. |
| 5,265,874 | A | 11/1993 | Dickinson et al. |
| 5,429,361 | A | 7/1995 | Raven et al. |
| 5,457,306 | A | 10/1995 | Lucero |
| 5,470,079 | A | 11/1995 | LeStrange et al. |
| 5,642,160 | A | 6/1997 | Bennett |
| 5,663,546 | A | 9/1997 | Cucinotta et al. |
| 5,679,938 | A | 10/1997 | Templeton et al. |
| 5,741,183 | A | 4/1998 | Acres et al. |
| 5,754,655 | A | 5/1998 | Hughes et al. |
| 5,766,075 | A | 6/1998 | Cook et al. |
| 5,770,533 | A | 6/1998 | Franchi |
| 5,864,623 | A | 1/1999 | Messina et al. |
| 5,902,983 | A | 5/1999 | Crevelt et al. |
| 5,919,091 | A | 7/1999 | Bell et al. |
| 5,959,277 | A | 9/1999 | Lucero |
| 5,991,410 | A | 11/1999 | Albert et al. |
| 5,999,624 | A | 12/1999 | Hopkins |
| 6,001,016 | A | 12/1999 | Walker et al. |
| 6,048,269 | A | 4/2000 | Burns et al. |
| 6,048,271 | A | 4/2000 | Barcelou |
| 6,064,987 | A | 5/2000 | Walker et al. |
| 6,081,792 | A | 6/2000 | Cucinotta et al. |
| 6,124,947 | A | 9/2000 | Seo |
| 6,162,122 | A | 12/2000 | Acres et al. |
| 6,168,522 | B1 | 1/2001 | Walker et al. |
| 6,244,958 | B1 | 6/2001 | Acres |
| 6,275,991 | B1 | 8/2001 | Erlin |
| 6,293,866 | B1 | 9/2001 | Walker et al. |
| 6,302,793 | B1 | 10/2001 | Fertitta, III et al. |
| 6,347,738 | B1 | 2/2002 | Crevelt et al. |
| 6,352,205 | B1 | 3/2002 | Mullins et al. |
| 6,361,437 | B1 | 3/2002 | Walker et al. |
| 6,409,595 | B1 | 6/2002 | Uihlein et al. |
| 6,431,983 | B2 | 8/2002 | Acres |
| RE37,885 | E | 10/2002 | Acres et al. |
| 6,486,768 | B1 | 11/2002 | French et al. |
| 6,487,284 | B1 | 11/2002 | Campbell |
| 6,505,772 | B1 | 1/2003 | Mollett et al. |
| 6,547,131 | B1 | 4/2003 | Foodman et al. |
| 6,575,832 | B1 | 6/2003 | Manfredi et al. |
| 6,579,179 | B2 | 6/2003 | Poole et al. |
| 6,585,598 | B2 | 7/2003 | Nguyen et al. |
| 6,601,040 | B1 | 7/2003 | Kolls |
| 6,607,441 | B1 | 8/2003 | Acres |
| 6,675,152 | B1 | 1/2004 | Prasad et al. |
| 6,682,421 | B1 | 1/2004 | Rowe et al. |
| 6,709,333 | B1 | 3/2004 | Bradford et al. |
| 6,739,972 | B2 | 5/2004 | Flanagan-Parks et al. |
| 6,800,029 | B2 | 10/2004 | Rowe et al. |
| 6,843,412 | B1 | 1/2005 | Sanford |
| 6,846,238 | B2 | 1/2005 | Wells |
| 6,852,031 | B1 | 2/2005 | Rowe |
| 6,866,586 | B2 | 3/2005 | Oberberger et al. |
| 6,890,258 | B2 | 5/2005 | Weiss |
| 6,951,302 | B2 | 10/2005 | Potts |
| 6,997,807 | B2 | 2/2006 | Weiss |
| 7,003,496 | B2 | 2/2006 | Ishii et al. |
| 7,168,089 | B2 | 1/2007 | Nguyen et al. |
| 7,366,695 | B1 | 4/2008 | Allen-Rouman et al. |
| 8,096,872 | B2 | 1/2012 | Walker et al. |
| 8,556,707 | B2 | 10/2013 | Potts et al. |
| 2001/0022849 | A1 | 9/2001 | Simonoff |
| 2002/0002075 | A1 | 1/2002 | Rowe |
| 2002/0039923 | A1 | 4/2002 | Cannon |
| 2002/0045476 | A1 | 4/2002 | Poole et al. |
| 2002/0104878 | A1 | 8/2002 | Seifert et al. |
| 2002/0107072 | A1 | 8/2002 | Giobbi |
| 2002/0132664 | A1 | 9/2002 | Miller et al. |
| 2002/0147047 | A1 | 10/2002 | Letovsky et al. |
| 2002/0177479 | A1 | 11/2002 | Walker et al. |
| 2003/0004876 | A1 | 1/2003 | Jacobson |
| 2003/0033534 | A1 | 2/2003 | Rand et al. |
| 2003/0036425 | A1 | 2/2003 | Kaminkow et al. |
| 2003/0045353 | A1 | 3/2003 | Paulsen et al. |
| 2003/0078094 | A1 | 4/2003 | Gatto et al. |
| 2003/0087692 | A1 | 5/2003 | Weiss |
| 2003/0104865 | A1 | 6/2003 | Itkis et al. |
| 2003/0106769 | A1 | 6/2003 | Weiss |
| 2003/0176218 | A1 | 9/2003 | LeMay et al. |
| 2003/0186747 | A1 | 10/2003 | Nguyen et al. |
| 2003/0211883 | A1 | 11/2003 | Potts |
| 2003/0222153 | A1 | 12/2003 | Pentz et al. |
| 2003/0228902 | A1 | 12/2003 | Walker et al. |
| 2003/0236749 | A1 | 12/2003 | Shergalis |
| 2004/0053693 | A1 | 3/2004 | An |
| 2004/0173673 | A1 | 9/2004 | Potts |
| 2004/0214643 | A1 | 10/2004 | Parrott et al. |
| 2004/0229671 | A1 | 11/2004 | Stronach et al. |
| 2005/0009600 | A1 | 1/2005 | Rowe et al. |
| 2005/0015332 | A1 | 1/2005 | Chen |
| 2005/0054417 | A1 | 3/2005 | Parrott et al. |
| 2005/0054446 | A1 | 3/2005 | Kammler et al. |
| 2005/0080728 | A1 | 4/2005 | Sobek |
| 2005/0096124 | A1 | 5/2005 | Stronach |
| 2005/0107155 | A1 | 5/2005 | Potts et al. |
| 2005/0107156 | A1 | 5/2005 | Potts et al. |
| 2006/0131395 | A1 | 6/2006 | Potts et al. |
| 2006/0148559 | A1 | 7/2006 | Jordan et al. |
| 2006/0160610 | A1 | 7/2006 | Potts |
| 2007/0060309 | A1 | 3/2007 | Yankton et al. |
| 2007/0066386 | A1 | 3/2007 | Shields |
| 2007/0213124 | A1 | 9/2007 | Walker et al. |
| 2009/0029763 | A1 | 1/2009 | Schwartz |
| 2009/0048973 | A1 | 2/2009 | DeCristoforo |
| 2009/0065573 | A1 | 3/2009 | Potts et al. |
| 2011/0231314 | A1 | 9/2011 | Sears et al. |

FOREIGN PATENT DOCUMENTS

| | | |
|---|---|---|
| WO | 93/23817 | 11/1993 |
| WO | 94/16781 | 8/1994 |
| WO | 97/13228 | 4/1997 |
| WO | 01/57617 | 8/2001 |

OTHER PUBLICATIONS

AAMVA National Standard for the Driver License/Identification Card, AAMVA DL/ID-2000, American Association of Motor Vehicle Administrators, pp. 1-90, Jun. 30, 2000.

International Search Report and Written Opinion for International Application No. PCT/US04/32358, filed Oct. 1, 2004, dated Feb. 26, 2007.

MULTI-FUNCTION CASHLESS GAMING ATM

RELATED APPLICATION DATA

The present invention is a continuation of U.S. application Ser. No. 15/137,693, filed Apr. 25, 2016, which is a continuation of U.S. patent application Ser. No. 14/051,156, filed Oct. 10, 2013, now U.S. Pat. No. 9,324,210, which is a continuation of U.S. patent application Ser. No. 10/956,644, filed Oct. 1, 2004, now U.S. Pat. No. 8,556,707, which claims priority to U.S. Provisional Application Ser. No. 60/508,063, filed Oct. 1, 2003.

FIELD OF THE INVENTION

The present application relates to systems and methods for redeeming value tickets.

BACKGROUND OF THE INVENTION

The present invention relates to a system and method for performing ticket redemption transactions for a customer. Specifically, the invention relates to a system and method, used in a variety of environments including casinos, to facilitate cashless gaming. A gaming device, such as a slot machine, will issue a ticket rather than cash or coin, which is then redeemable by the customer through various mediums, such as a casino cashier or multi-function cashless gaming Automated Teller Machine, or ATM.

Because casinos have an interest in maintaining a high level of customer satisfaction, it is advantageous to provide customers with the ability to easily and effectively manage their winnings in a manner that empowers them to quickly collect their money in a form of their choosing. However, existing redemption methods require numerous steps and other burdens. Therefore, there is a need for a system and method of redeeming a customer's winnings in a prompt and seamless manner that provides the customer with the flexibility of deciding how and when to collect the money.

SUMMARY OF THE INVENTION

The present invention generally relates to a system and method for allowing a customer to redeem his or her winnings from a gaming machine, such as a slot machine, in a casino environment. After a player has accrued winnings at a gaming machine and has finished playing, the player indicates to the machine that he or she is ready to cash out. Rather than issuing cash, the method of the present invention includes issuing the customer a unique ticket that is associated with the amount the customer has won. This "cashless gaming" aspect of the present invention avoids issuing the player burdensome coins to lug about the casino. Then, at the player's convenience, the ticket is introduced into a multi-function cashless gaming ATM for redemption. Further objects, features, and advantages of the present invention over the prior art will become apparent from the detailed description of the drawings which follows, when considered with the attached figures.

The multi-function ATM is configured to perform traditional transactions such as cash withdrawal, credit/debit card cash advance transactions, and electronic fund transfers. The ATM of the present invention also provides for the additional task of ticket redemption transactions. The ticket includes encoded data, such as a barcode, which is read by the multi-function ATM as the ticket is introduced. The ticket may be introduced by a number of methods, such as swiping it through a ticket reader on the ATM. The encoded data on the ticket is electronically processed by the multi-function ATM to retrieve the information represented by the data. For instance, where the encoded data is a barcode the information retrieved is a number, or another unique identifier, represented by the barcode.

Once the number, or another unique identifier stored on the ticket, has been retrieved, the ATM validates the ticket. The unique identifier is verified against a redemption ticket database, which indicates whether the ticket has been previously redeemed. If the ticket has not yet been redeemed, the procedure continues. The redemption ticket database also stores multiple identifiers and associates each identifier with a predetermined dollar value based on players' winnings at various gaming machines. Once the redemption ticket database determines the predetermined dollar value associated with the specific identifier on the player's ticket, the dollar value is returned to the multi-function ATM.

Upon verifying that the ticket is valid and receiving the predetermined dollar value, the multi-function ATM transfers an award to the player that is equal to the predetermined dollar value associated with the ticket. If the system collects a commission for performing the redemption transaction, the award amount may be reduced by the commission fee. The player can select a redemption type for receiving the award, such as cash, credit, or deposit. Where the selected redemption type is cash, the multi-function ATM dispenses cash to the player that is equal to the predetermined dollar value, less applicable fees. Once the multi-function ATM has transferred the award to the player, the redemption ticket database is updated to indicate that the redemption ticket has been redeemed. Accordingly, an attempt to subsequently redeem the same ticket again will fail.

In another aspect of the present invention, the selected redemption type is credit. The player introduces his or her credit card into the multi-function ATM, and the credit card is then electronically processed. The ATM retrieves the machine readable information stored on the credit card, and electronically issues a credit request to a credit card authorization server. The credit request utilizes the machine readable information stored on the credit card and the predetermined dollar value as the basis of the request. If the request is approved, a credit card account, which is associated with the credit card, is credited an appropriate amount.

In yet another aspect of the present invention, the selected redemption type is deposit. The player introduces his or her ATM card into the multi-function ATM, and the ATM card is then electronically processed. The ATM retrieves the machine readable information stored on the ATM card and electronically issues a deposit request. The deposit request utilizes the machine readable information stored on the ATM card and the predetermined dollar value as the basis of the request. If the request is approved, a deposit is made in an appropriate amount to a banking account that is associated with the ATM card.

In addition, another aspect of the present invention allows a customer to use a player tracking card ("PTC") to receive cash or credit from the multi-function ATM based on the points accumulated by the cardholder and associated with the PTC. It is common for casinos to issue player tracking cards, which are used to track players' activities in the casino and award points for certain actions. Typically, the points can be redeemed for a variety of goods and services, such as free or discounted meals, hotel accommodations, and gift shop items. In the system of the present invention, the points accumulated by a player can also be redeemed by the multi-function ATM for cash or credit. This process is similar to redeeming a redemption ticket, only rather than introducing a ticket to the ATM, the player introduces his or her PTC to the ATM. The ATM decodes the magnetic strip on the PTC, retrieves the associated player and point information, and redeems the points for the appropriate cash or credit.

DETAILED DESCRIPTION OF THE INVENTION

Figure 1:
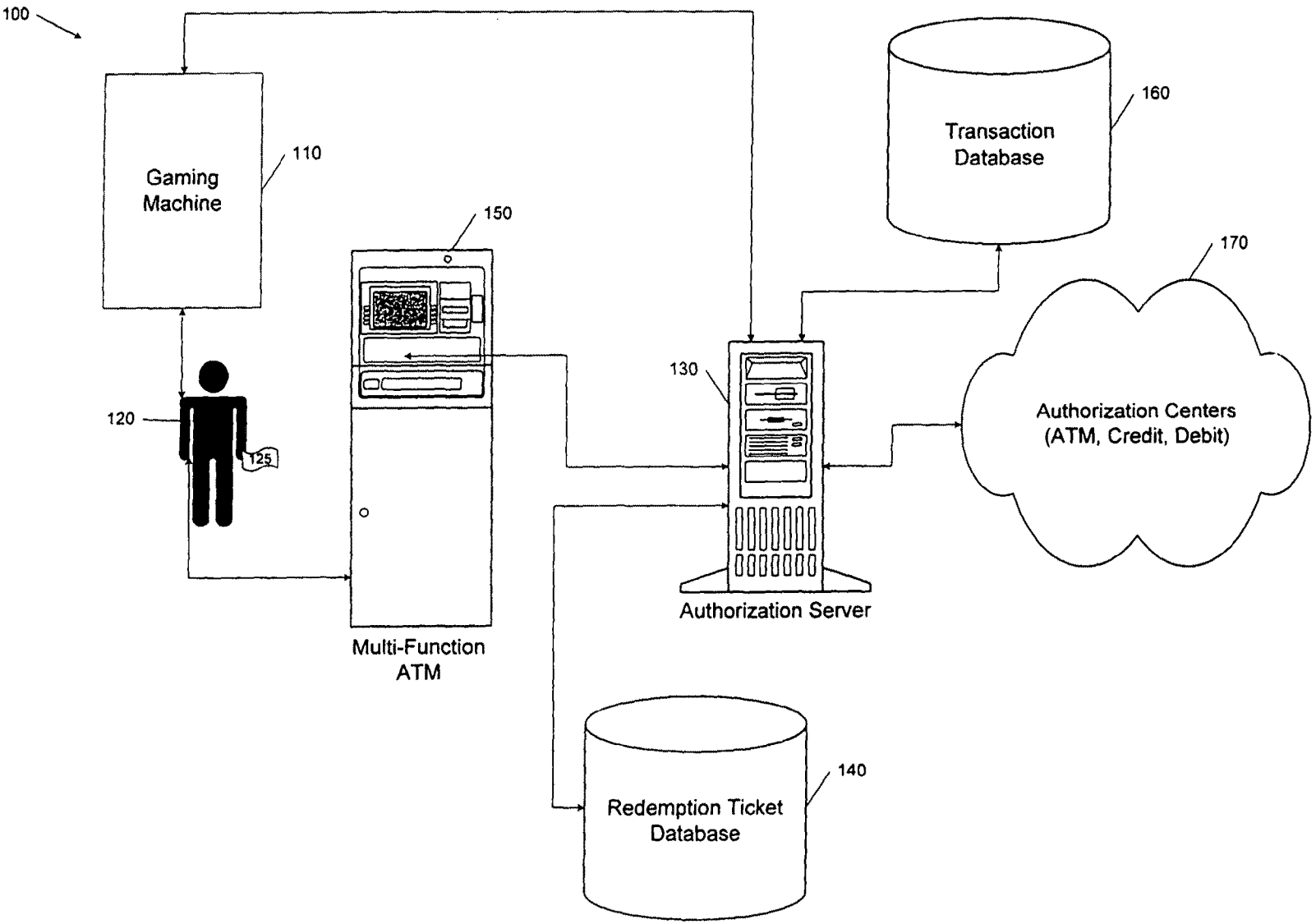
FIG. 1 is a block diagram of a cashless gaming ticket redemption transaction system in accordance with an embodiment of the present invention.

One embodiment of a cashless gaming ticket redemption transaction system 100 is shown in FIG. 1. In a preferred embodiment, the cashless gaming ticket redemption transaction system 100, which contains the elements described herein, is operated in a casino environment. The system 100 includes a plurality of gaming machines 110 and players 120 who play and interact with the gaming machines. The gaming machines 110 are configured to issue cashless gaming tickets 125, or "redemption tickets," to the players 120 based on the players' winnings as described in more detail below. Each ticket 125 issued by a gaming machine 110 includes an encoded unique identifier. The gaming machines also communicate with an authorization server 130 to transmit information relating to the cashless gaming tickets 125 and the players' winnings. The authorization server 130 stores a subset of the information it receives on a redemption ticket database 140 for subsequent retrieval.

As described in more detail below, a player 120 that has been issued a ticket 125 can bring the ticket to a multi-function ATM 150. The player interacts with the ATM 150 through any methods known in the art such as buttons and touch-sensitive screens. The ATM 150 is configured to perform traditional transactions such as cash withdrawal, credit/debit transactions, and electronic fund transfers. These operations are well known in the art and are not elaborated on herein. The ATM 150 of the present invention is also configured to perform ticket redemption transactions. Accordingly, the ATM 150 reads, validates, and processes the ticket 125 to redeem the player's winnings.

To perform these functions, the ATM 150 communicates with the authorization server 130. The authorization server 130 in turn communicates with the redemption ticket database to validate the ticket 125 and retrieve information about the associated winnings. The redemption ticket database 140 stores multiple unique identifiers, each representing a redemption ticket issued to a player, and associates each identifier with a predetermined dollar value based on players' winnings at various gaming machines. The authorization server 130 many also communicate with various authorization centers 170 for redemption to credit card accounts and checking/savings accounts.

The redemption transactions that are performed on the multi-function ATM 150 and the authorization server 130 are tracked and stored on a transaction database 160. In one embodiment, the customer transaction history on the transaction database 160 for specific customers can be accessed by the authorization server 130. In this embodiment, the customer must identify himself or herself to the ATM, for instance, by introducing a casino-issued "player tracking" or VIP card to the ATM that uniquely identifies the customer. The transaction database 160 can also store additional information regarding customers' credit history as well as marketing information. When a commission is collected for utilizing the cashless gaming ticket redemption transaction system 100, the appropriate commission information for each player is also stored on the transaction database 160 as well as commission fee overrides for certain players such as VIP's.

Figure 2:
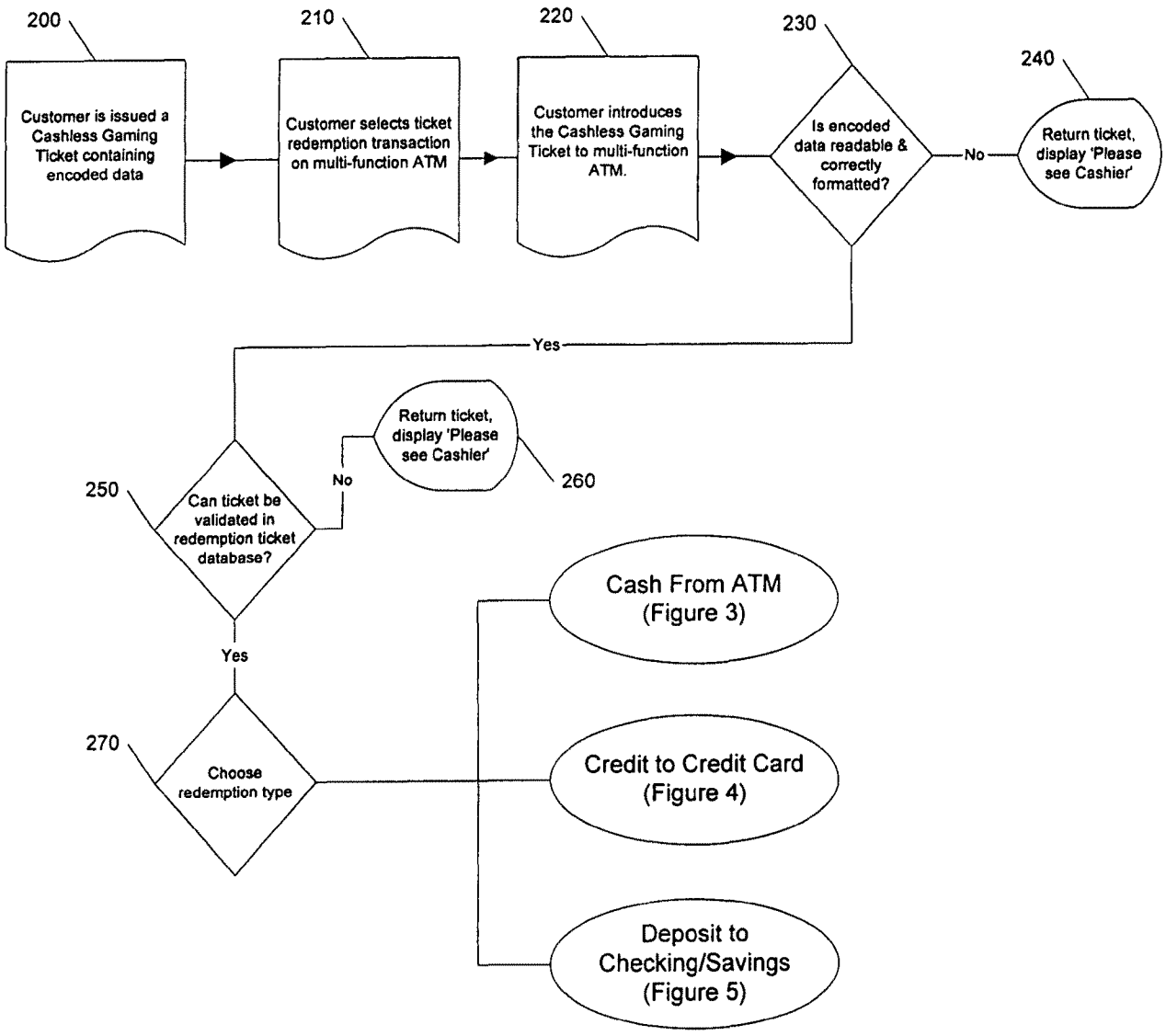
FIG. 2 is a flow diagram of a method for initiating a ticket redemption transaction on a multi-function ATM in accordance with the present invention.

In operation, and with reference to FIGS. 1 and 2, after a player 120 has accrued winnings at the gaming machine 120 and has finished playing, the player 120 indicates to the gaming machine 110 that he or she is ready to cash out. In response, the gaming machine 110 at step 200 issues the player 120 a unique cashless gaming ticket 125. The ticket 125 includes encoded data that represents a unique identifier for the ticket 125. In one embodiment, the encoded data is a barcode that represents a unique number, which is the unique identifier associated with that ticket.

The gaming machine 110 also transmits pertinent winnings information to the authorization server 130, as shown in FIG. 1. That information may include the dollar value of the winnings accrued by the player 120 while playing on the gaming machine 120 as well as the unique identifier for the ticket 125 that is issued to the player 120. The authorization server 130 stores the information it receives from the gaming machine 110 on the redemption ticket database 140. The redemption ticket database 140 stores and associates the player's winnings with the unique identifier.

At the player's convenience, he or she can take the ticket 125 to the multi-function cashless gaming ATM 150, which, in the preferred embodiment, is also located in the casino environment. Because the ATM 150 performs multiple types of transactions, the player selects a "redemption" transaction on the ATM 150 at step 210. At step 220, the player 120 introduces the ticket 125 into the multi-function ATM 150 for redemption. The ATM 150 may accept the ticket through a variety of means, such as a ticket reader (not shown) as is known in the art. In one embodiment, the ticket 125 may be swiped through the ticket reader. As the ticket 125 is introduced, the ATM 150 attempts to read the encoded data.

At step 230, the ATM 150 determines whether the encoded data is readable and correctly formatted. At step 240, if the encoded data is unreadable or the format is not recognizable, the transaction fails and the ATM 150 displays an error message to the player 120, indicating that the player 120 should see the cashier (not shown) at the casino. If the encoded data is readable and correctly formatted, the data is electronically processed by the multifunction ATM 150 to retrieve the information represented by the encoded data. In one embodiment, the encoded data is a barcode and the information retrieved from the ticket 125 is the unique number represented by that barcode.

Once the number, or another unique identifier stored on the ticket 125, has been processed, the ATM 150 validates the ticket 125 at step 250. The unique identifier is verified against the redemption ticket database 140. The ATM 150 communicates with the authorization server 130, which in turn communicates and issues queries to the redemption ticket database 140. The data from the redemption ticket database 140 is communicated to the authorization server 130 and then transmitted back to the ATM 150. At step 260, if the ticket 125 cannot be verified against the redemption ticket database 140, the transaction fails and the ATM 150 displays an error message to the player 120, indicating that the player 120 should see the cashier (not shown) at the casino.

If the ticket 125 is successfully validated, the ATM 150 prompts the player with the choice of transaction types for redeeming the winnings at step 270. In one embodiment, the transaction types include "Cash from ATM," "Credit to Credit Card," and "Deposit to Checking/Savings Account."

Figure 3:
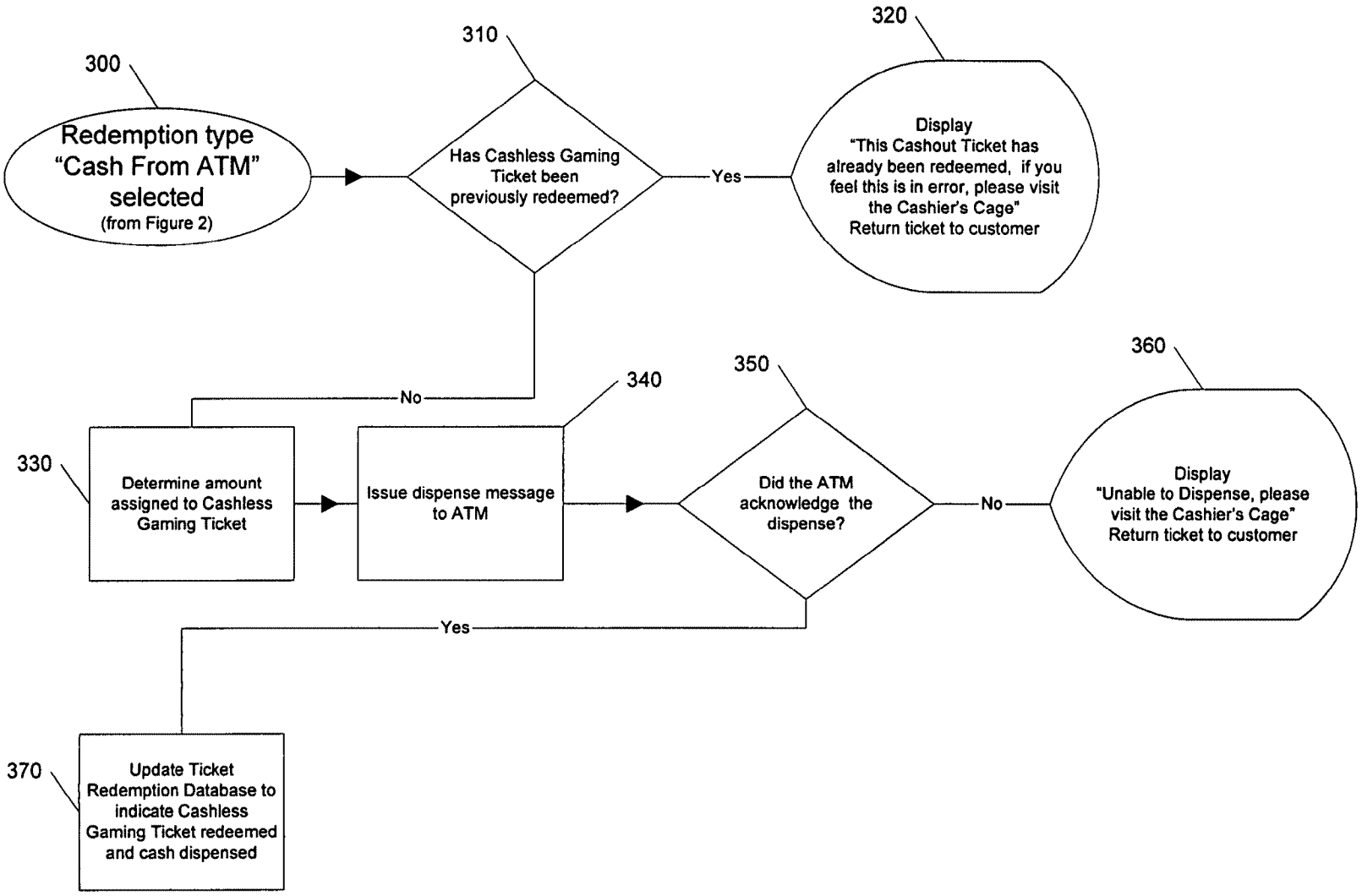
FIG. 3 is a flow diagram of a method for completing a ticket redemption transaction with a cash redemption in accordance with the present invention.

With reference to FIGS. 1 and 3, if the player 120 selects the redemption type "Cash from ATM," step 300, the ATM 150 proceeds with a cash redemption. The ATM 150 verifies whether the ticket 125 has been previously redeemed, step 310, by communicating with the redemption ticket database 140 through the authorization server 130. The redemption ticket database 140 maintains redemption data for each ticket and transmits to the ATM 150 verification of whether the ticket 125 has been redeemed.

At step 320, if the ticket 125 has been previously redeemed, the ATM 150 displays a message to the player 120 indicating the previous redemption and that the player 120 may see the cashier (not shown) if the player believes an error has occurred. If the ticket 125 has not been previously redeemed, the ATM proceeds with the transaction by determining the player's winnings and the amount that will be awarded, step 330.

To ascertain this amount, the ATM 150 communicates with the authorization server 130, which queries the redemption ticket database 140. As previously described, the redemption ticket database 140 stores and associates information relating to the tickets 125 and the players' winnings. The redemption ticket database returns to the authorization server 130 the winnings associated with the ticket 125. In one embodiment, the ticket 125 contains winning value, which is confirmed against the redemption ticket database. The authorization server 130 then determines the amount to be redeemed, which is typically the player's winnings minus a commission or transaction fee. The appropriate commission may be determined based on the specific player redeeming the ticket. A player profile (not shown) may be stored on the transaction database 160, which indicates the player's preference level. For instance, while a new player may have a standard commission taken out of the winnings, a VIP player may have the commission waived altogether based on the player profile.

Once the winnings associated with the ticket 125, less the commission if any, has been established, the authorization sever 130 transmits this redemption value to the ATM 150. At step 340, the authorization server 130 issues a dispense message for the ATM 150 to dispense the appropriate redemption value to the player 120 in cash. In response to the message, the ATM 150 attempts to dispense the redemption amount in cash. At step 350, the authorization server 130 determines whether the ATM 150 acknowledges the dispense message. At step 360, if the ATM does not acknowledge the dispense message, the transaction fails, and the ATM 150 displays an error message to the player 120 that the ATM is unable to dispense the cash and that the player should see the cashier. At step 370, if the ATM does acknowledge the dispense message, the authorization server 130 updates the redemption ticket database 140 to indicate that the ticket 125 has been redeemed and the cash has been dispensed, thereby completing the cash redemption of the cashless gaming ticket 125.

Figure 4:
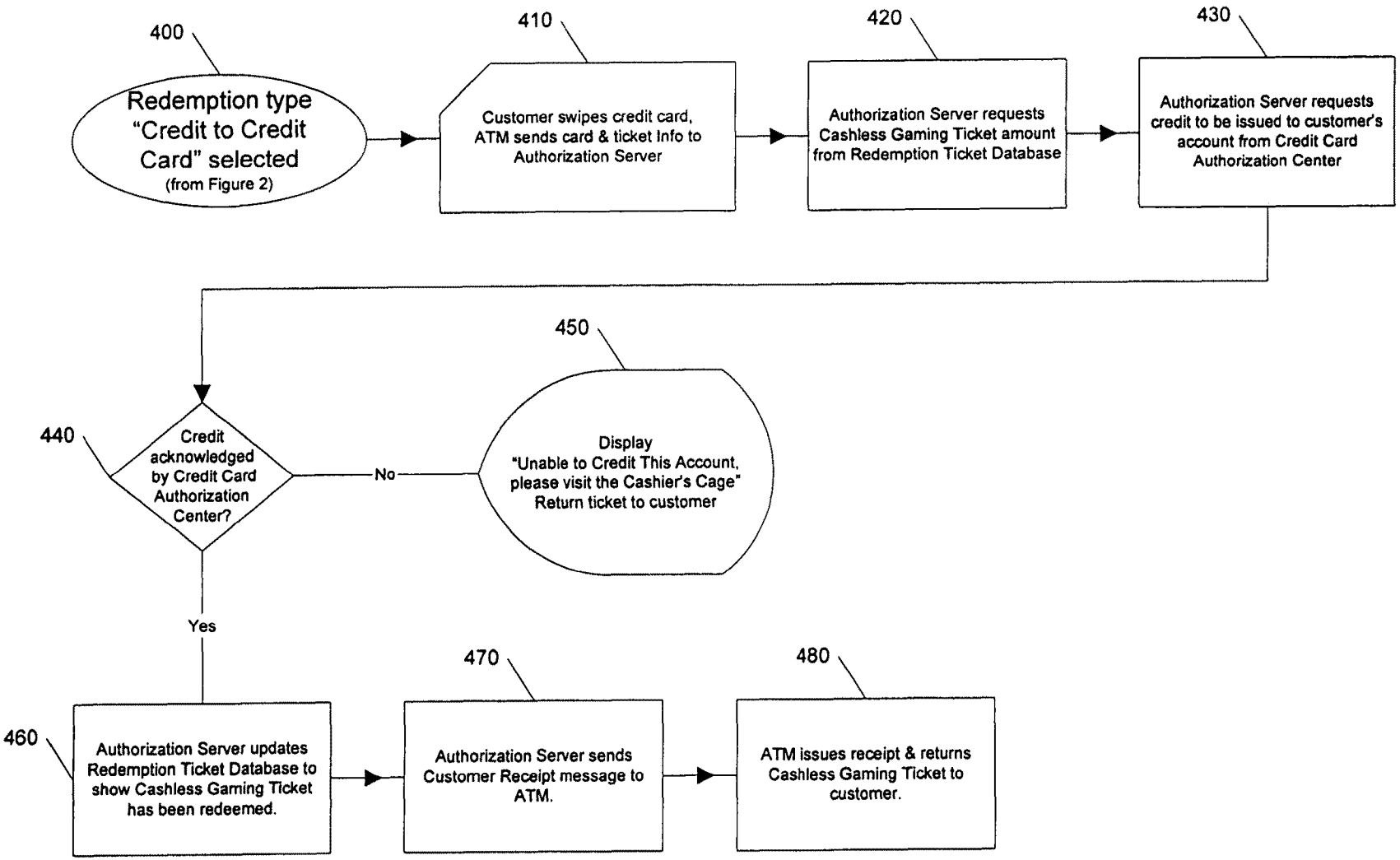
FIG. 4 is a flow diagram of a method for completing a ticket redemption transaction with a credit redemption in accordance with the present invention.

Now with reference to FIGS. 1 and 4, if the player 120 selects a the redemption type "Credit to Credit Card," step 400, the ATM 150 proceeds with a credit redemption. The ATM 150 prompts the player 120 to provide a credit card (not shown) belonging to the player. At step 410, the player 120 swipes the credit card through a credit card reader (not shown) of the ATM or otherwise introduces the credit card to the ATM through a method known in the art. In a preferred embodiment, the credit card reader reads the magnetic strip on the credit card, decodes the data therein, and transmits the data to the authorization server 130 as is known in the art. At step 420, as in step 330, the authorization server also determines the player's winnings and the amount that will be awarded.

At step 430, the authorization server 130 electronically issues a credit request to the credit card authorization center 170. The credit request causes the authorization center 170 to attempt to credit a credit card account belonging to the player 120 for the redemption value, the amount of the player's winnings less any commission. If the credit request is successful and the player's credit card account is credited the appropriate amount, the authorization center 170 acknowledges the successful transaction to the authorization server 130. At step 440, the authorization server 130 determines whether the credit request was acknowledged by the authorization center 170. At step 450, if the request was not acknowledged, the ATM 150 displays a message to the player 120 indicating that the credit card account was not credited and that the player 120 may see the cashier (not shown) if the player believes an error has occurred. At step 460, if the request was properly acknowledged and the account was credited, the authorization server 130 updates the redemption ticket database 140 to indicate that the ticket 125 has been redeemed and the player's account has been credited.

At step 470, the authorization server 130 transmits a receipt message to the ATM 150, instructing the ATM to issue a receipt to the player 120 for the transaction. At step 480, the ATM issues a receipt, and returns the ticket 125 if necessary, to the player thereby completing the credit-type redemption of the cashless gaming ticket 125.

Figure 5:
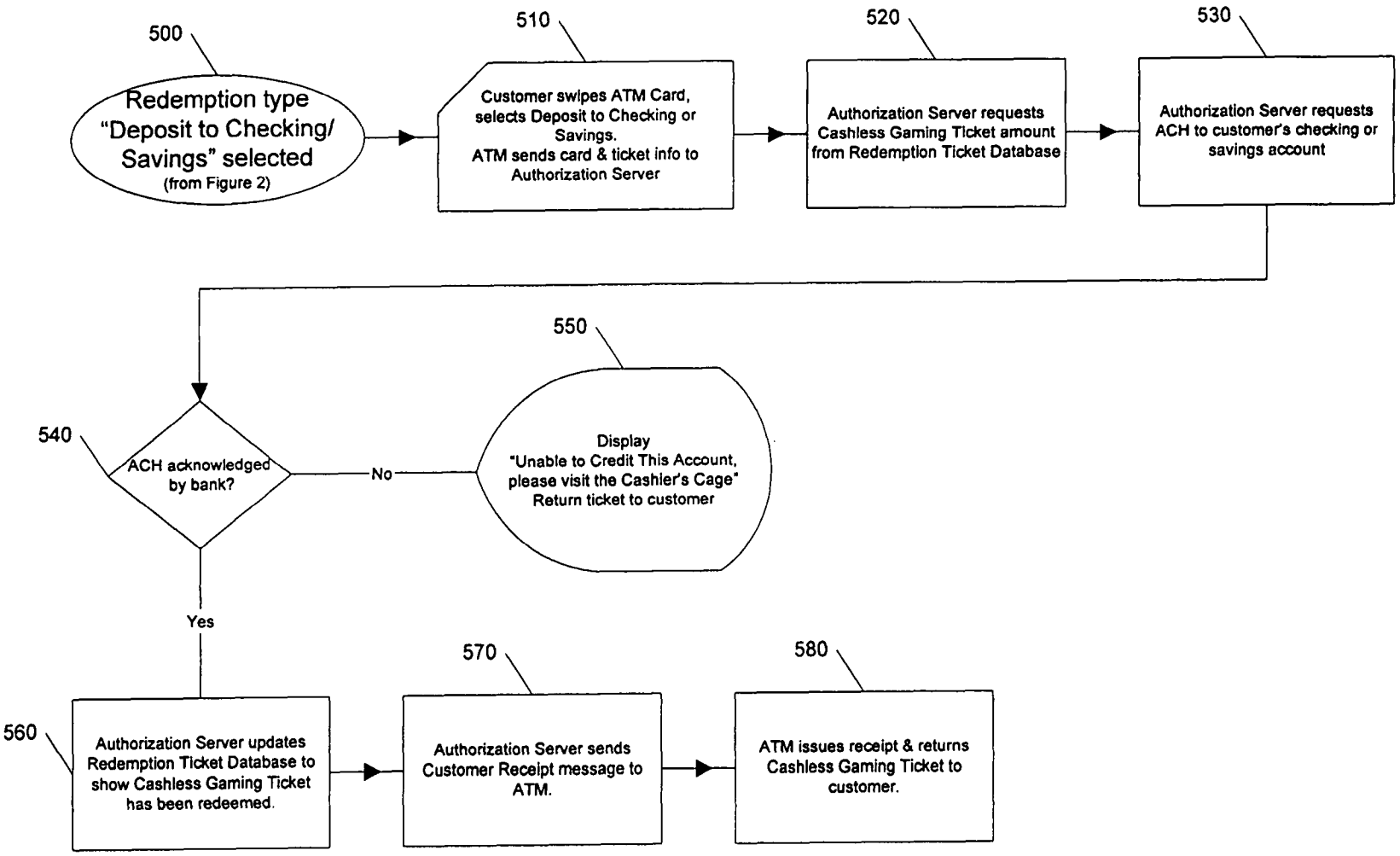
FIG. 5 is a flow diagram of a method for completing a ticket redemption transaction with a deposit redemption in accordance with the present invention.

Now with reference to FIGS. 1 and 5, if the player 120 selects a the redemption type "Deposit to Checking/Savings," step 500, the ATM 150 proceeds with a deposit redemption. The ATM 150 prompts the player 120 to provide an ATM card (not shown) belonging to the player. At step 510, the player 120 swipes the ATM card through a card reader (not shown) of the ATM or otherwise introduces the ATM card to the ATM through a method known in the art. In a preferred embodiment, the card reader reads the magnetic strip on the ATM card, decodes the data therein, and transmits the data to the authorization server 130 as is known in the art. The ATM 150 prompts the player 120 to select between depositing to a checking account or a savings account that is associated with the ATM card, and the player selects the desired banking account. At step 520, as in step 330, the authorization server also determines the player's winnings and the amount that will be awarded.

At step 530, the authorization server 130 electronically issues a deposit request to an ATM authorization center 170. The deposit request causes the authorization center 170 to attempt to deposit the amount of the player's winnings, less any commission, into the selected banking account. In one embodiment, the transaction initiated by the deposit request is an Automatic Clearing House ("ACH") transaction. If the ACH, or other transaction type, is successful and the player's banking account is credited the appropriate amount, the authorization center 170 acknowledges the successful transaction to the authorization server 130. At step 540, the authorization server 130 determines whether the deposit request was acknowledged. At step 550, if the request was not acknowledged, the ATM 150 displays a message to the player 120 indicating that the banking account was not credited and that the player 120 may see the cashier (not shown) if the player believes an error has occurred. At step 560, if the request was properly acknowledged, the authorization server 130 updates the redemption ticket database 140 to indicate that the ticket 125 has been redeemed and the player's account has been credited.

At step 570, the authorization server 130 transmits a receipt message to the ATM 150, instructing the ATM to issue a receipt to the player 120 for the transaction. At step 580, the ATM issues a receipt, and returns the ticket 125 if necessary, to the player thereby completing the deposit-type redemption of the cashless gaming ticket 125.

Figure 6:
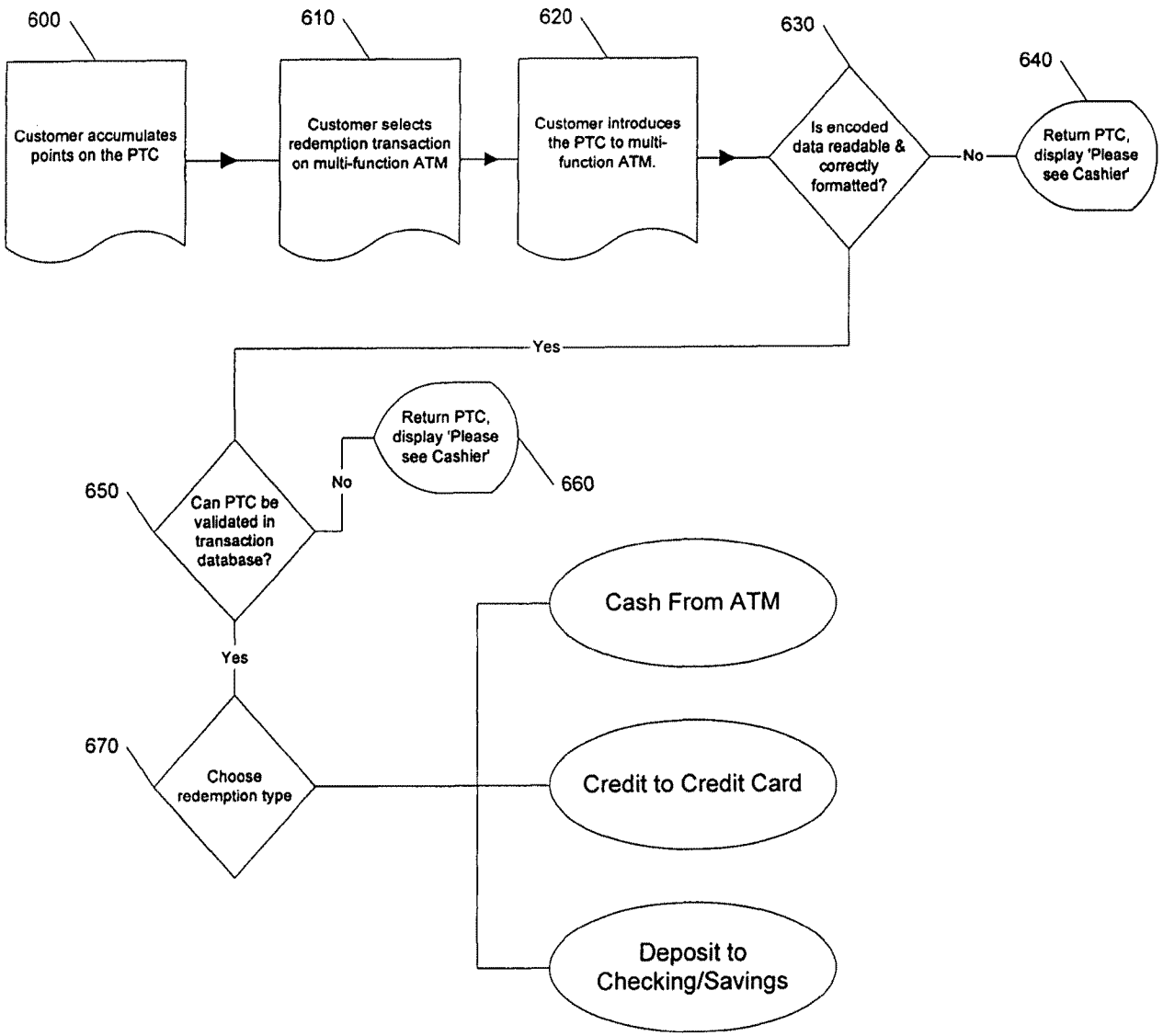
FIG. 6 is a flow diagram of a method for initiating a gaming point redemption transaction on a multi-function ATM in accordance with the present invention.

In another aspect of the present invention, the player 120 may also complete a redemption transaction using a player tracking card ("PTC") (not shown) to receive cash or credit from the multi-function ATM 150. The PTC is a casino-issued card, which is used to track the player's actions in the casino. The casino awards points for certain player actions and associates the points with the PTC on the transaction database 160. The transaction database maintains each players' total award points and increments and decrements the total points according to the players' accumulation and usage of points. The player 120 is able to redeem the points associated with his or her PTC in a similar fashion to the ticket 125. For instance, with reference to FIG. 6, to redeem points the player 120 must first accumulate the points, step 600, through various casino-related activities such as playing gaming machines.

As described herein, when the player 120 is ready to redeem the PTC points for cash or credit, the player selects a redemption transaction on the multi-function ATM 150, step 610. At step 620, the player 120 introduces the PTC to the ATM 150, which reads the PTC. The PTC includes machine readable information, which is stored on the PTC by a storage means such as a magnetic strip, barcode, integrated circuit, digital image, optical memory, or finger imaging. The ATM 150 is configured to read the machine readable information through a means such as a card reader (not shown). If the machine readable information is encoded, the card reader attempts to decode the information into a format usable by the ATM 150. At step 630, the ATM determines whether the machine readable information on the card is readable and correctly formatted. At step 640, if the machine readable information is not readable and correctly formatted, the ATM 150 displays a message to the player 120 indicating the error.

At step 650, if the machine readable information is readable and correctly formatted, the ATM 150 attempts to identify the player 120 and determine whether the PTC can be validated against the transaction database 160 by transmitting the decoded information from the ATM 150 to the authorization server 130. The authorization server 130 then communicates with the transaction database 160 to verify that the PTC is valid and to identify the player 120. At step 660, if the PTC cannot be validated, the ATM 150 displays a message to the player 120 indicating the error.

At step 670, if the PTC is successfully validated, the ATM 150 prompts the player 120 with the choice of transaction types for redeeming the winnings. Upon selection of a transaction type, the ATM proceeds with redeeming the player's points, much like redeeming a player's winnings as described herein and illustrated in FIGS. 3, 4, and 5. The primary functional difference between redeeming winnings through a ticket and redeeming points through a PTC occurs when determining the appropriate award value. Rather than requesting the predetermined dollar value from the redemption ticket database, the ATM 150 requests the number of points associated with the PTC from the transaction database 160 and ensures that the number of points exceeds a minimum threshold or is at least non-zero. For instance, the ATM 150 instructs the authorization server 130 to request the number of points accumulated by the player 120 associated with the PTC in the transaction database 160.

Based on a point-to-dollar conversion provided to the authorization server 130, the server is able to calculate the dollar value represented by the points accumulated by the player 120. The ATM 150 prompts the player 120 to determine whether the he or she wishes to redeem all of the accumulated points or only a portion of the points. Upon determining the number of points to redeem, the ATM proceeds with the redemption transaction in accordance with player's selected transaction type.

Figure 7:
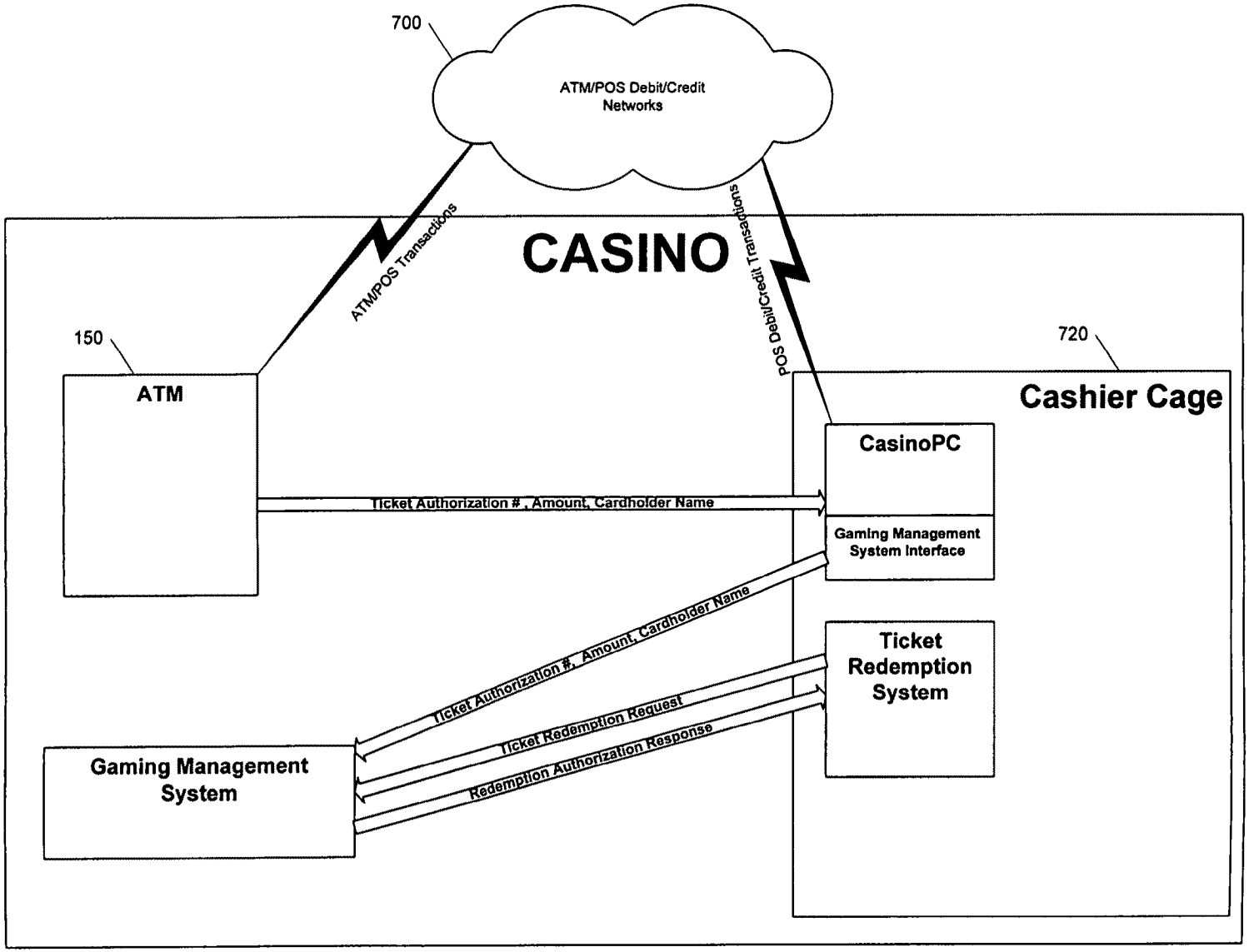
FIG. 7 is a flow diagram of a method for generating a casino ticket transaction on a multi-function ATM in accordance with the present invention.

FIG. 7 provides a flow diagram illustrating another embodiment of the present invention. In this embodiment, the ATM 150 can be used to dispense a casino ticket or other identification card that represents a cash value. In the first step, the casino patron (customer) swipes their identification card (such as a debit card, a credit card, a state issued ID or other identification token) and selects a financial transaction. In this example, the selected financial transaction would be the acquisition of a casino "ticket". Following selection, an amount of money is entered and an account type is selected, such as an ATM and/or POS debit or credit request. In the preferred embodiment, an account type is selected in order to minimize any fees, overhead and/or monetary limits. For example, a POS debit transaction may be preferred because it provides a higher limit withdrawal limit. Once the withdrawal amount and financial account have been collected, the ATM 150 requires confirmation of identity by asking for a secret password, or code or other security device. Once the player 120 confirms his/her identity, the ATM 150 will perform the requested transaction by transmitting request information to the ATM/Credit/POS debit network 700.

In the preferred embodiment, a third party intermediary records audit information associated with any requests and approvals in order to support redemption and anti-fraud detection systems managed by a casino or by the third party intermediary. Following approval of the transaction and creation of an audit trail, a casino ticket (not shown) with the withdrawal value (or some portion thereof) is issued to the player 120 by the ATM 150. In this context, a casino ticket can be any number of identification cards or systems including a paper ticket with a bar code, a magnetic stripe card, a smart card, RFID or other portable digital memory that is encoded with personal and financial information. This casino ticket can then be used on a gaming machine as credit in connection with casino gaming or redeemed for cash. In the preferred embodiment, the customer 120 can either present the casino ticket for validation by a cashier at a cashier cage 720 or insert the casino ticket into a ticket redemption kiosk (including kiosks integrated with one or more casino game machines or other multi-purpose entertainment devices).

FIG. 7 provides a flow diagram illustrating one system that can be used for converting a ATM/POS debit/credit transaction into a negotiable casino ticket. As one skilled in the art would know, such a system provides a number of advantages over the prior art. The casino ticket could be negotiable within different areas (such as a group of mutually linked casinos, restaurants and service providers), to acquire different products or services (such as 50% or more must be used to purchase goods), to trigger different bonuses or awards (free games, discounts, casino points), or any number of features that either limit negotiation or enhance the functionality and features available to the player 120.

For example, a customer/player 120 could link a debit card with a player-tracking card in a casino database such that, whenever that same debit card is used to acquire a casino ticket, the ticket is encoded with that customer's player tracking code or ID. This could further be used to initiate certain security procedures or verifications that are stored in the casino's database and are associated with that player tracking code. A player could be asked to enter certain identification information (something they know, something they have or something they are) on certain types of types of machines. Likewise, gaming features could be provided at casino gaming machines in which such a casino ticket was entered. A customer that has entered a casino ticket onto a game machine could be provided with gaming audio and visual content that is associated with the user in the casino's player tracking/customer database.

This embodiment provides a number of advantages. The casino ticket provides a simple financial tool that is highly managed from both an access standpoint (through dynamic security), from a negotiation standpoint (where it can be used and how) that is still highly portable and personalized.

Those skilled in the art will further appreciate that the present invention may be embodied in other specific forms without departing from the spirit or central attributes thereof. In that the foregoing description of the present invention discloses only exemplary embodiments thereof, it is to be understood that other variations are contemplated as being within the scope of the present invention. For instance, the redemption types include not only cash/credit/deposit, but they may include any redemption type practicable on an ATM. Similarly, the unique identifier on the tickets is not limited to barcodes, but may take any form known in the art. Accordingly, the present invention is not limited in the particular embodiments, which have been described in detail therein. Rather, reference should be made to the appended claims as indicative of the scope and content of the present invention.

What is claimed is:

1. A method for redeeming a cashless gaming ticket, the method comprising:

receiving a request to redeem a cashless gaming ticket at a multi-function automated teller machine ("ATM"), the cashless gaming ticket comprising encoded data representing a unique identifier associated with the cashless gaming ticket;

receiving the cashless gaming ticket at the multi-function ATM via a ticket reading device at the multi-function ATM and reading the unique identifier from the encoded data;

validating the unique identifier by sending the unique identifier read at the multi-function ATM for comparison against codes in a redemption ticket database and receiving validation of the unique identifier at the multi-function ATM including information regarding a monetary value associated with the unique identifier;

receiving an input via an input device at the multi-function ATM to conduct a redemption to a checking or savings bank account transaction;

receiving bank account information at the multi-function ATM via a card reading device and sending the bank account information to an authorization server;

receiving at the authorization server the monetary value associated with the unique identifier encoded on the cashless gaming ticket;

transmitting, from the authorization server, a request for credit to be issued in the amount of the monetary value to said checking or savings bank account via an authorization center and receiving confirmation from the authorization center when the credit is applied to the bank account;

sending the confirmation to the redemption ticket database and the multi-function ATM indicating that the monetary value is redeemed; and confirming at the multi-function ATM that the cashless gaming ticket is redeemed and the credit is applied to the bank account.

2. The method according to claim 1, wherein when the confirmation from the authorization center is not received, displaying a message at a display of the multi-function ATM indicating that the credit has not been applied to the account.

3. The method according to claim 1, wherein the bank account information is received in response to a prompt displayed at a display of the multi-function ATM.

4. The method according to claim 1, wherein the cashless gaming ticket is issued from a gaming machine.

5. The method according to claim 1, wherein the encoded data comprises a bar code.

6. The method according to claim 1, wherein the encoded data comprises one of a magnetic strip, integrated circuit, digital image, finger imaging, and optical memory.

7. The method according to claim 1, wherein the step of validating the unique identifier comprises determining, via one or more servers, whether the cashless gaming ticket has been previously redeemed.

8. The method according to claim 1, wherein the amount of the monetary value is decreased by a transaction fee.

9. The method according to claim 1, wherein the authorization center comprises an ACH clearinghouse.

10. A system for redeeming a cashless gaming ticket, the system comprising:

a gaming machine that presents one or more games to a user, the gaming machine being configured to issue a cashless gaming ticket to the user, the cashless gaming ticket comprising a encoded data including a unique identifier;

a redemption ticket database communicatively coupled with the gaming machine, the redemption ticket database receiving the unique identifier and an associated monetary value, the associated monetary value being based on winnings accrued by the user at the gaming machine;

a multi-function ATM comprising at least one display, a ticket reading device, a card reading device, and a transceiver to send and receive information from external devices; and one or more authorization servers, at least one of the authorization servers configured to receive the unique identifier from the multi-function ATM based on a cashless gaming ticket being received at the ticket reading device of the multi-function ATM, validate the unique identifier with the redemption ticket database, and receive the monetary value associated with the unique identifier; and at least one of the authorization servers configured to receive bank account information obtained from a bank card presented to the card reading device of the multi-function ATM, request credit to be issued in the amount of the monetary value to the bank account associated with the bank card information via an authorization center and receive confirmation from the authorization center when the credit is applied to the account, and send the confirmation to the redemption ticket database and the multi-function ATM indicating that the monetary value is redeemed.

11. The system according to claim 10, wherein when the confirmation from the authorization center is not received, the authorization system sending information to the multi-function ATM to display a message at the at least one display of the multi-function ATM indicating that the credit has not been applied to the account.

12. The system according to claim 10, wherein the bank account information is received in response to a prompt displayed at a display of the multi-function ATM.

13. The system according to claim 10, wherein the encoded data comprises a bar code.

14. The system according to claim 10, wherein the encoded data comprises one of a magnetic strip, integrated circuit, digital image, finger imaging, and optical memory.

15. The system according to claim 10, wherein validating the unique identifier comprises determining whether the cashless gaming ticket has been previously redeemed.

16. The system according to claim 10, wherein the amount of the monetary value is decreased by a transaction fee.

17. A method for redeeming a cashless gaming ticket, the method comprising:

receiving a request to redeem a cashless gaming ticket at a multi-function automated teller machine ("ATM"), the cashless gaming ticket comprising encoded data representing a unique identifier associated with the cashless gaming ticket;

receiving the cashless gaming ticket at the multi-function ATM via a ticket reading device at the multi-function ATM and reading the unique identifier from the encoded data;

validating the unique identifier by sending the unique identifier read at the multi-function ATM for comparison against codes in a redemption ticket database and receiving validation of the unique identifier at the multi-function ATM including information regarding a monetary value associated with the unique identifier;

receiving an input via an input device at the multi-function ATM to conduct a redemption to a credit and/or debit card transaction;

receiving credit and/or debit card information at the multi-function ATM via a card reading device and sending the bank account information to an authorization server;

receiving at the authorization server the monetary value associated with the unique identifier encoded on the cashless gaming ticket;

transmitting, from said authorization server, a request for credit to be issued in the amount of the monetary value to an account associated with the credit and/or debit card information via a card authorization center and receiving confirmation from the card authorization center when the credit is applied to the account;

sending the confirmation to the redemption ticket database and the multi-function ATM indicating that the monetary value is redeemed; and confirming at the multi-function ATM that the cashless gaming ticket is redeemed and the credit is applied to the account.

18. The method according to claim 17, wherein when the confirmation from the card authorization center is not received, displaying a message at a display of the multi-function ATM indicating that the credit has not been applied to the account.

19. The method according to claim 17, wherein credit and/or debit card information is received in response to a prompt displayed at a display of the multi-function ATM.

20. The method according to claim 17, wherein the cashless gaming ticket is issued from a gaming machine.

21. The method according to claim 17, wherein the encoded data comprises a bar code.

22. The method according to claim 17, wherein the encoded data comprises one of a magnetic strip, integrated circuit, digital image, finger imaging, and optical memory.

23. The method according to claim 17, wherein the step of validating the unique identifier comprises determining, via at least one server, whether the cashless gaming ticket has been previously redeemed.

24. The method according to claim 17, wherein the amount of the monetary value is decreased by a transaction fee.

25. The method according to claim 18, wherein the card authorization center comprises a card network.

26. A system for redeeming a cashless gaming ticket, the system comprising:

a gaming machine that presents one or more games to a user, the gaming machine being configured to issue a cashless gaming ticket to the user, the cashless gaming ticket comprising a encoded data including a unique identifier;

a redemption ticket database communicatively coupled with the gaming machine, the redemption ticket database receiving the unique identifier and an associated monetary value, the associated monetary value being based on winnings accrued by the user at the gaming machine;

a multi-function ATM comprising at least one display, a ticket reading device, a card reading device, and a transceiver to send and receive information from external devices; and one or more authorization servers, at least one of the authorization servers configured to receive the unique identifier from the multi-function ATM based on a cashless gaming ticket being received at the ticket reading device of the multi-function ATM, validate the unique identifier with the redemption ticket database, and receive the monetary value associated with the unique identifier; and at least one of the authorization servers configured to receive credit and/or debit credit card information obtained from a debit and/or credit card presented to the card reading device of the multi-function ATM, request credit to be issued in the amount of the monetary value to an account associated with the credit and/or debit card information via a card authorization center and receive confirmation from the card authorization center when the credit is applied to the account, and send the confirmation to the redemption ticket database and the multi-function ATM indicating that the monetary value is redeemed.

27. The system according to claim 26, wherein when the confirmation from the card authorization center is not received, sending information to the multi-function ATM to display a message at the at least one display of the multi-function ATM indicating that the credit has not been applied to the account.

28. The system according to claim 26, wherein the credit and/or debit card information is received in response to a prompt displayed at a display of the multi-function ATM.

29. The system according to claim 26, wherein the encoded data comprises a bar code.

30. The system according to claim 26, wherein the encoded data comprises one of a magnetic strip, integrated circuit, digital image, finger imaging, and optical memory.

31. The system according to claim 26, wherein validating the unique identifier comprises determining whether the cashless gaming ticket has been previously redeemed.

32. The system according to claim 26, wherein the amount of the monetary value is decreased by a transaction fee.

* * * * *